US008540350B2

(12) United States Patent
Barbet

(10) Patent No.: US 8,540,350 B2
(45) Date of Patent: Sep. 24, 2013

(54) CONTINUOUS INK-JET PRINTING DEVICE, WITH IMPROVED PRINT QUALITY AND AUTONOMY

(75) Inventor: Bruno Barbet, Etoile-sur-Rhone (FR)

(73) Assignee: Markem-Imaje, Bourg-les-Valence (FR)

( * ) Notice: Subject to any disclaimer, the term of this patent is extended or adjusted under 35 U.S.C. 154(b) by 0 days.

(21) Appl. No.: 13/511,135

(22) PCT Filed: Nov. 22, 2010

(86) PCT No.: PCT/EP2010/067937

§ 371 (c)(1),
(2), (4) Date: May 21, 2012

(87) PCT Pub. No.: WO2011/061331

PCT Pub. Date: May 26, 2011

(65) Prior Publication Data

US 2012/0281047 A1 Nov. 8, 2012

Related U.S. Application Data

(60) Provisional application No. 61/290,321, filed on Dec. 28, 2009.

(30) Foreign Application Priority Data

Nov. 23, 2009 (FR) ..... 09 58276

(51) Int. Cl.
*B41J 2/02* (2006.01)

(52) U.S. Cl.
USPC ..... 347/73

(58) Field of Classification Search
USPC ..... 347/73–79, 80–82, 90
See application file for complete search history.

(56) References Cited

U.S. PATENT DOCUMENTS

| | | | | |
|---|---|---|---|---|
| 4,210,919 | A | 7/1980 | Aiba | |
| 4,381,515 | A | 4/1983 | Bain | |
| 4,521,786 | A | 6/1985 | Bain | |
| 4,695,854 | A | 9/1987 | Cruz-Uribe | |
| 4,730,197 | A | 3/1988 | Raman et al. | |
| 5,438,350 | A | 8/1995 | Kerry | |
| 5,801,732 | A | 9/1998 | Pengelly | |
| 6,010,202 | A | 1/2000 | Arnott | |
| 6,394,363 | B1 | 5/2002 | Arnott et al. | |
| 7,273,269 | B2 * | 9/2007 | Hawkins et al. | 347/73 |
| 7,673,976 | B2 * | 3/2010 | Piatt et al. | 347/74 |
| 7,730,197 | B2 | 6/2010 | Bauman et al. | |
| 8,226,199 | B2 * | 7/2012 | Hawkins et al. | 347/73 |
| 2005/0035986 | A1 | 2/2005 | Iwao et al. | |

(Continued)

FOREIGN PATENT DOCUMENTS

| | | | |
|---|---|---|---|
| EP | 0 063 921 | A1 | 11/1982 |
| EP | 1 693 203 | A2 | 8/2006 |

(Continued)

*Primary Examiner* — Kristal Feggins
(74) *Attorney, Agent, or Firm* — Miles & Stockbridge P.C.

(57) ABSTRACT

A continuous ink-jet printer or a print head of such a printer which includes electrical means for compensating for mechanical crosstalk between adjacent stimulation chambers, where these means simultaneously with the transmission, to a stimulated chamber, of a stimulation pulse on a stimulation line send a pulse for compensating for mechanical crosstalk on each of the lines supplying an actuator for the chamber adjacent to the stimulated chamber. Specific ratios between the peak amplitude of pulse for compensating for crosstalk and the peak voltage value of the stimulation pulse are provided as a function of the gaps between consecutive nozzles.

10 Claims, 6 Drawing Sheets

(56) References Cited

U.S. PATENT DOCUMENTS

| | | | | |
|---|---|---|---|---|
| 2006/0262168 | A1* | 11/2006 | Hawkins et al. | 347/74 |
| 2009/0244135 | A1 | 10/2009 | Kaieda et al. | |

FOREIGN PATENT DOCUMENTS

| | | | |
|---|---|---|---|
| EP | 1 695 826 | A2 | 8/2006 |
| EP | 1 731 308 | A1 | 12/2006 |
| FR | 2 479 095 | A1 | 10/1981 |
| FR | 2 936 976 | A1 | 4/2010 |
| JP | 11 157056 | A | 6/1999 |
| WO | WO 2005/070676 | A2 | 8/2005 |
| WO | WO 2007/042530 | A1 | 4/2007 |
| WO | WO 2008/040777 | A1 | 4/2008 |

* cited by examiner

CONTINUOUS INK-JET PRINTING DEVICE, WITH IMPROVED PRINT QUALITY AND AUTONOMY

This application is a 371 of PCT Application No. PCT/EP2010/067937 filed Nov. 22, 2010, which claims the priority benefit of U.S. Provisional Application No. 61/290,321 filed Dec. 28, 2009.

TECHNICAL FIELD

The invention relates to the field of continuous ink-jet printers with a multi-nozzle print head.

It also relates to the print head of such printers.

PRIOR ART

Multi-nozzle continuous ink-jet printers include a print head. This head includes an ink drop generator, one or more drop charge electrodes and one or more drop deflection electrodes. The ink drop generator includes in particular one or more ink supply conduits, stimulation chambers which are hydraulically connected with ink jet discharge nozzles. In addition the generator includes means for stimulation and one or more gutters for recovering ink ejected by the discharge nozzles and which is not used for printing. The ink arrives under pressure through ink supply conduits until it is inside the stimulation chamber and emerges in the form of an ink jet through each of the discharge nozzles.

The operation is as follows:

A means for stimulation which is mechanically coupled to each stimulation chamber periodically produces a pulse. This pulse causes a local variation in the diameter of the jet present at the nozzle discharge, which is expressed as a break in the jet at some distance from the nozzle. The operation of charge electrodes placed downstream of the nozzle depends on a signal which represents the data to be printed, so that the drops are either electrically charged or not. Charged drops are then deflected by the deflection electrodes. In one printer embodiment it is the charged drops which strike the printed medium, with the non-deflected drops being recovered through the recovery gutter and returned to the ink circuit. In general, in this first mode, referred to as a deflected continuous jet type, drops may be deflected according to different degrees so that the drops coming from a single nozzle can trace a segment that is perpendicular to a direction of movement of the printed medium. The value of the deflection of a drop is adjusted by means for the voltage value applied to the charge electrode, which itself determines the value of the charge given to this drop, or through the value of a voltage applied to a deflection electrode assigned to the discharge nozzle for this drop. An example of such an embodiment is, for example, described in the U.S. Pat. No. 4,210,919 in the name of Aiba. In another embodiment, known as a binary continuous jet, drops are charged or are not charged by charge electrodes depending on the design to be printed. Electrically charged drops are deflected by deflection electrodes placed downstream of the nozzle and charge electrodes. In general, in this embodiment it is the non-deflected drops which strike the printed medium, whereas the deflected drops are recovered through the gutter. In the embodiments that have just been described, the charge and/or deflection electrodes are each coupled to a device for processing the data to be printed which receives a signal carrying the data to be printed. Depending on the data relating to the design to be printed, the device for processing the data to be printed issues voltages to the charge and deflection electrodes whose value decides the path of the drops sent from each nozzle, to the recovery gutter or to the location that they must reach in order to create the design to be printed. Because the voltages applied to the electrodes are relatively high, and also because, for example, a charge electrode A assigned to a nozzle a is very close to a charge electrode B assigned to an immediately adjacent nozzle b, the supply circuits for these electrodes are very close together. This results in electrical crosstalk occurring between these circuits. This results in printing errors.

In one embodiment specific to the Markem-Imaje company, the body of the drop generator of the print head in an inkjet printer is formed of an assembly of several plates held mechanically together by, for example, diffusion bonding or by adhesive. Such bodies are described in detail, for example, in U.S. Pat. Nos. 4,695,854 or 7,730,197, both attributed to Pitney Bowes Inc. The bodies described in these patents are associated with a drop-on-demand printer. In one embodiment of a printer specific to the Markem-Imaje company which may or may not include a drop generator body made up of an assembly of several plates, and to which the invention applies, each stimulation device is electrically coupled to a device for processing the data to be printed which receives the signal carrying the data to be printed. In this embodiment the result of the processing of the printing data is applied to the piezoelectric actuators which are each mechanically coupled to a stimulation chamber, and not downstream of the discharge nozzles, at the charge or deflection electrodes. This means that the electrical supply circuits for these electrodes can be simplified. In an embodiment described, for example, in patent application WO 2007/042530 published on Apr. 4, 2007, in the name of the MARKEM-IMAJE company, the signal is constituted by two pulses which are spaced apart over time to differing degrees depending on the drop one wishes to obtain. It has been observed, however, that after a period of satisfactory operation, printing defects appear. In the initial stage of the research into the causes of the defects, they were attributed to progressive fouling of the charge and deflection electrodes.

It will be seen later that after research and experimentation the inventors discovered that the problem of fouling of charge or deflection electrodes could result in crosstalk between two adjacent chambers. This is why reference is made hereafter to the prior art relating to crosstalk in printers.

In order to resolve crosstalk problems in a drop on demand printer, U.S. Pat. No. 4,521,786 from the Xerox Corporation describes electronics for controlling the piezoelectric actuators in which the voltage level and step duration are programmable. The objective is to ensure that the drop speed and volume of ink ejected are identical for each printed point, irrespective of the design to be printed. These control electronics are complex and are both digital and analogue.

U.S. Pat. No. 5,438,350 by the XAAR Limited company provides minimising mechanical crosstalk in a drop-on-demand printer by selecting a favourable ratio between the flexibility of the walls of the stimulation chamber and the compressibility of the ink contained in the chambers.

U.S. Pat. No. 6,394,363 by the Technology Partnership PLC company relates to a drop-on-demand printing technology based on the mechanical displacement of the nozzle by means for a piezoelectric element surrounding the nozzle. The mechanical crosstalk is reduced by creating a slit between two nozzles which is machined into both the nozzle plate and into the piezoelectric layer. The mechanical deformation which is gradually transmitted by the nozzle plate is thus blocked by the slit through removal of the mechanical continuity.

Patent application EP 1693203 from the Brother Industries Ltd company proposes reduction in mechanical crosstalk between adjacent chambers of a drop-on-demand printer by reducing the mechanical coupling between adjacent chambers through the creation of grooves in the diaphragm, a mechanical component coupled to the piezoelectric system, at the periphery of the stimulation chamber. Thus the diaphragm is freer to undergo deformation, which enhances stimulation whilst reducing the mechanical transmission of forces between chambers, which reduces the mechanical crosstalk.

Patent application EP 1731308 by the OCE Technologies BV company offers a solution for reducing the mechanical crosstalk between adjacent chambers by compensating for the mechanical crosstalk due to the diaphragm with another mechanical crosstalk which occurs through the walls which separate the adjacent chambers, where the two crosstalks are in phase opposition. The resulting volume of ink discharged due to mechanical crosstalk is therefore zero, or greatly reduced, when there is correct dimensioning of the print head.

Patent application EP 1695826 by the Toshiba Tec KK company reveals a method for active compensation of the mechanical crosstalk which is limited to the operation of the piezoelectrics in "Shear Mode". For a given stimulation chamber by means for which an ink drop is ejected, both walls, which face each other and which are made up of a piezoelectric actuator part, move in an opposite direction to each other in order to maximise the variation in volume for the production of drops. Conversely, the walls of adjacent stimulation chambers not destined to eject drops are moved in the same direction so as to cancel out the variation in volume and thus suppress the mechanical coupling with the adjacent stimulated chamber. In order to achieve movement of the walls this patent envisages electronics which operate analogue switches with several voltage levels.

U.S. Pat. No. 5,801,732 by the Dataproducts Corporation company provides minimising the drop mass and speed distributions in a drop-on-demand printer which result from mechanical crosstalk by offsetting in time the moment at which drops are emitted. The delay is of very short duration compared with the period which results from the drop emission frequency. The consequences of this offset in time on printing quality are deemed to be minor in comparison with the advantages.

U.S. Pat. No. 6,010,202 by the Xaar Technology Limited proposes a chronology for the ejection of specific drops for a drop-on-demand printer whose piezoelectrics operate in "Shear Mode". In the structure described, the nozzles are gathered together in groups and the stimulation signal is a succession of steps the first of which produces the drop at a given speed, with the following steps cancelling out the residual pressure waves. The step is constructed by an empirical learning approach (trial and error). The major drawback of such a step technology is that it does not cancel out crosstalk in real time (that is, at any given moment), irrespective of the shape of the signals applied to the transducers.

Finally, U.S. Pat. No. 4,381,515 describes a drop-on-demand printer in which the ejection of a drop is controlled by a pulse on a piezoelectric crystal which surrounds a tube, one end of which includes the discharge nozzle. Each piezoelectric crystal is coupled by an electrical supply line to means for generating drop ejection pulses. In order to reduce the mechanical crosstalk between the stimulated tube and a tube adjacent to the latter, a resistance is introduced between a first supply line and a second supply line, where these first and second lines supply the piezo-electrics of tubes which are adjacent to each other. Thus electrical crosstalk is created between each of the lines which supply the crystal of any tube whatsoever and each of the lines which supply a crystal arranged on a tube which is adjacent to the said any tube. According to this patent U.S. Pat. No. 4,381,515, it has been determined that crosstalk may be positive or negative. In the case of positive crosstalk, the speed of a drop ejected by an adjacent tube is increased, and is conversely decreased in the case of negative crosstalk. Depending on whether the crosstalk is positive or negative, the link resistance is placed upstream or downstream of the crystal. The upstream-downstream direction is the direction of circulation of the control pulses.

The solutions proposed above are all applied to drop-on-demand printers.

The purpose of the invention is to improve both the print quality and autonomy of printers which use continuous jet technology.

DESCRIPTION OF THE INVENTION

The research into the origin of defects revealed gradual fouling of the charge and deflection electrodes. In order to determine the origin of the contamination, the inventors observed in detail the straightness of the jets at the nozzle discharge and the formation of any satellites during the break up of the jet into drops. These observations on the straightness and on the break up of jets allowed straightness defects to be discounted. It was observed, however, that in normal operation, the break up of the jets occurred at unforeseen locations and in an erratic manner. It was observed that erratic jet break up often occurs on a jet next to a stimulated jet, but not always at the same distance from the nozzle. Then the influence of stimulation of a chamber on the break-up distance of a jet emerging from a nozzle which is hydraulically linked to a chamber adjacent to the stimulated chamber was investigated. It was observed that the break up distance of a jet emerging from a chamber adjacent to the stimulated chamber was modified. The jet break-up distance for the chamber adjacent to the stimulated chamber becomes smaller than the natural break-up distance. The break-up distance for this same jet when it is stimulated at the same time as that of an adjacent chamber becomes greater than the expected break-up distance in the case of stimulated jet. In both cases (with the adjacent chamber jet being stimulated or not stimulated) the break-up distance does not occur at the expected distance. The crosstalk between ink distribution nozzles is a known phenomenon in drop-on-demand printing. As explained above, the drop generator body used in the Markem Imaje continuous jet printer is of similar construction to that described in U.S. Pat. Nos. 4,695,854 or 4,730,197, both attributed to Pitney Bowes. These bodies do not exhibit crosstalk in drop-on-demand use whereas for a drop-on-demand printer the stimulation energies for a chamber are much greater than the energy used to modify the jet break-up distance. In drop-on-demand printers the energy sent to a chamber actuator must be sufficient not only to produce a jet from a drop from the nozzle, but also to provide it with a sufficient speed to project the drop onto a printed medium. In continuous jet technology, the purpose of stimulation is simply to produce an acoustic wave, which, by disturbing the jet will cause surface undulation of the jet in which the depression must be of sufficient depth to break up the jet. Thus, for a given drop generator, the stimulation energy required to eject a drop and to give it a desired speed is much greater than the energy required simply to break up a jet emerging from the nozzle. In the present case, the body of the print head used is approximately constructed like that of the drop-on-demand printer print head described in the U.S. Pat. No. 4,730,197 already cited. The inventors felt however that paradoxically, due to the low stimulation energies of their continuous jet printer, weak crosstalk which would remain unnoticed in a drop-on-demand printer would be sufficient to disturb the operation of a continuous jet printer. By examining problems associated with crosstalk, the inventors observed that four different physical phenomena could be the cause:

1/ a phenomenon of a hydraulic nature, hereafter referred to as hydraulic crosstalk, in which the stimulation of a deliberately stimulated chamber is transmitted to adjacent chambers through a common ink supply reservoir. Transmission therefore occurs through the ink.

2/ a phenomenon which is mechanical in nature, hereafter referred to as mechanical crosstalk, in which mechanical deformation of the walls of a stimulated chamber, in particular the wall formed by the mechanical element, for example a conduit wall linked to a discharge nozzle coupled to the electromechanical actuator, is propagated through the mechanical structure to adjacent conduits.

3/ a phenomenon which is thermal in nature, hereafter referred to as thermal crosstalk, in which the heating of a chamber actuator due to the high frequency of stimulation of this actuator is propagated to chambers adjacent to the frequently stimulated chamber, whilst modifying the properties of the ink, for example its viscosity or the speed of sound in this ink.

4/ a phenomenon of an electrical nature, hereafter referred to as electrical crosstalk, in which the generally very dense connections produce interferences in the electrical lines in which the supply signals are supplied to the actuators in-drop on-demand printers or to electrodes in continuous ink jet printers.

In the present case the study has shown that the predominant crosstalk was probably mechanical.

Several solutions have already been proposed for preventing or limiting mechanical crosstalk. A few of these solutions have been described above in the paragraph relating to the prior art.

After recognising that erratic drop formation at unexpected locations could result from very weak mechanical crosstalk between adjacent stimulation chambers, the inventors have corrected this crosstalk by applying electrical compensation correction of the mechanical crosstalk.

Thus, in one aspect, the invention relates to a continuous inkjet printer which includes a print head which includes:

- multiple stimulation chambers aligned along an alignment axis for these chambers,
- a flat diaphragm whose parts form a wall of each of the stimulation chambers,
- multiple nozzles, each respectively hydraulically connected to one of the stimulation chambers,
- at least one charge electrode and a deflection electrode located downstream of the nozzles,
- multiple electro-mechanical actuators, each respectively being mechanically linked to each of the parts of the diaphragm forming a wall of each of the stimulation chambers,
- multiple stimulation lines each designed to transmit stimulation pulses to each of the various actuators,
- a device for processing of data to be printed which receives a signal carrying the data to be printed and which supplies stimulation pulses, as a function of this signal, to the electromechanical actuators,
  - means for compensating for mechanical crosstalk between adjacent chambers, where these means simultaneously send an electrical pulse to compensate for the mechanical crosstalk to each of the lines supplying an actuator for a chamber adjacent to the stimulated chamber. It is characterized in that the compensating means are adapted to transmit:
    - pulse for compensating for the crosstalk which peak amplitude is comprised between 0.05 hundredths and 0.5 hundredths of the peak voltage value of the stimulation pulse, where the gaps between consecutive nozzles are comprised between 2500 and 625 μm;
    - or pulse for compensating for the crosstalk which peak amplitude is comprised between 0.1 hundredths and 5 hundredths of the peak voltage value of the stimulation pulse, where the gaps between consecutive nozzles are comprised between 830 and 310 μm;
    - or pulse for compensating for the crosstalk which peak amplitude is comprised between 1 hundredth and 20 hundredths of the peak voltage value of the stimulation pulse, where the gaps between consecutive nozzles are comprised between 360 and 190 μm;
    - or pulse for compensating for the crosstalk which peak amplitude is comprised between 4 hundredths and 30 hundredths of the peak voltage value of the stimulation pulse, where the gaps between consecutive nozzles are comprised between 300 and 200 μm.

It is specified that there is a single actuator per stimulation chamber; similarly there is one stimulation line per actuator and each chamber is hydraulically linked to a single nozzle.

It will be noted that the means for compensating for mechanical crosstalk between adjacent chambers may be located at the printer, for example at the device for processing the data to be printed, or at the print head.

This means that the invention also relates to a print head for an inkjet printer which includes:

- multiple stimulation chambers aligned along an alignment axis for these chambers,
- a flat diaphragm whose parts form a wall of each of the stimulation chambers,
- multiple nozzles where each is respectively hydraulically connected to one of the stimulation chambers,
- at least one charge electrode and a deflection electrode located downstream of the nozzles,
- multiple electro-mechanical actuators, where each respectively is mechanically linked to each of the parts of the diaphragm forming a wall of each of the stimulation chambers,
- multiple stimulation lines each designed to transmit stimulation pulses to each of the various actuators,
  - means for compensating for mechanical crosstalk between adjacent chambers, where these means send, simultaneously with the transmission of a stimulation pulse over a line to a stimulated chamber, an electrical pulse to compensate for the mechanical crosstalk on each of the lines supplies an actuator of a chamber adjacent to the stimulated chamber. It is characterized in that the compensating means are adapted to transmit:
    - pulse for compensating for the crosstalk which peak amplitude is comprised between 0.05 hundredths and 0.5 hundredths of the peak voltage value of the stimulation pulse, where the gaps between consecutive nozzles are comprised between 2500 and 625 μm;
    - or pulse for compensating for the crosstalk which peak amplitude is comprised between 0.1 hundredths and 5 hundredths of the peak voltage value of the stimulation pulse, where the gaps between consecutive nozzles are comprised between 830 and 310 μm;

or pulse for compensating for the crosstalk which peak amplitude is comprised between 1 hundredth and 20 hundredths of the peak voltage value of the stimulation pulse, where the gaps between consecutive nozzles are comprised between 360 and 190 μm;

or pulse for compensating for the crosstalk which peak amplitude is comprised between 4 hundredths and 30 hundredths of the peak voltage value of the stimulation pulse, where the gaps between consecutive nozzles are comprised between 300 and 200 μm.

In one aspect, the means for compensating for mechanical crosstalk between adjacent chambers include passive coupling components of impedance Z2 between stimulation lines supplying actuators of adjacent chambers.

The passive coupling components form a voltage divider bridge made up on the one hand of the impedance Z1 of the stimulation line and on the other hand by the impedance Z2 which is electrically coupled between two stimulation lines supplying adjacent chambers.

The passive coupling components may be chosen from a group which includes, for example, a resistance, a capacitance, a resistance and a capacitance in series, a resistance and a capacitance in parallel.

In another aspect, the means for compensating for mechanical crosstalk between adjacent chambers includes two coupling Zener diodes between lines supplying actuators of adjacent chambers, where the two diodes have opposite passing directions.

The invention also relates to a method for reducing the consequences of mechanical crosstalk between adjacent stimulation chambers in the print head of a continuous inkjet printer which includes a flat diaphragm whose parts form a wall of each of the stimulation chambers, at least one charge electrode and a deflection electrode located downstream of the nozzles, electro-mechanical stimulation actuators for each chamber and multiple stimulation lines each designed to transmit stimulation pulses to each of the various actuators, characterised by the fact that when a stimulation pulse is sent to the actuator of a stimulated chamber, compensation pulses are sent to each of the chamber actuators adjacent to the stimulated chamber.

When the adjacent chamber is itself stimulated, the compensation and stimulation pulses are added together.

It became clear during the investigation that the relative value of the compensation pulse in relation to the stimulation pulse is, for a given material, a function of the thickness of the separation walls between consecutive stimulation chambers. By necessity, the thickness between consecutive chambers decreases when the gap between consecutive nozzles decreases. The distance between nozzles controls the number of dots per inch (DPI) for the printer.

In one embodiment the crosstalk compensation pulse has a peak amplitude which is such that the break-up distance of the jet from a nozzle which is hydraulically connected with a chamber adjacent to the stimulated chamber is sufficiently great for a drop formed at the break up point of the jet to have a trajectory which is not modified by the effect of the charge and deflection electrodes.

In one embodiment the crosstalk compensation pulse has a peak amplitude which is such that the break-up distance of the jet from a nozzle which is hydraulically connected with a chamber adjacent to the stimulated chamber is sufficiently great for it to be in a zone where an electric field of the charge and deflection electrodes is too small to have an influence on the trajectory of a drop formed at the break-up point.

BRIEF DESCRIPTION OF THE DRAWINGS

Other characteristics and advantages of the invention will emerge more clearly on reading the detailed description, which is given for illustrative purposes only and is in no way restrictive, with reference to the appended drawings in which.

DETAILED DESCRIPTION OF SPECIFIC EMBODIMENTS

Details of embodiments will now be described.

In the embodiment which is described below, the body 1 of the drop generator for the print head 70 is made up of a stack of plates assembled together, for example, by diffusion bonding under pressure or using adhesive as described in U.S. Pat. No. 4,730,197. For further details on this embodiment of the body, and in particular for details relating to the ink inlets, ink reservoir and to the restrictions, reference can be made to the explanations given in that patent. The present description will be limited to a description of elements which are of use in understanding the invention.

Figure 1:
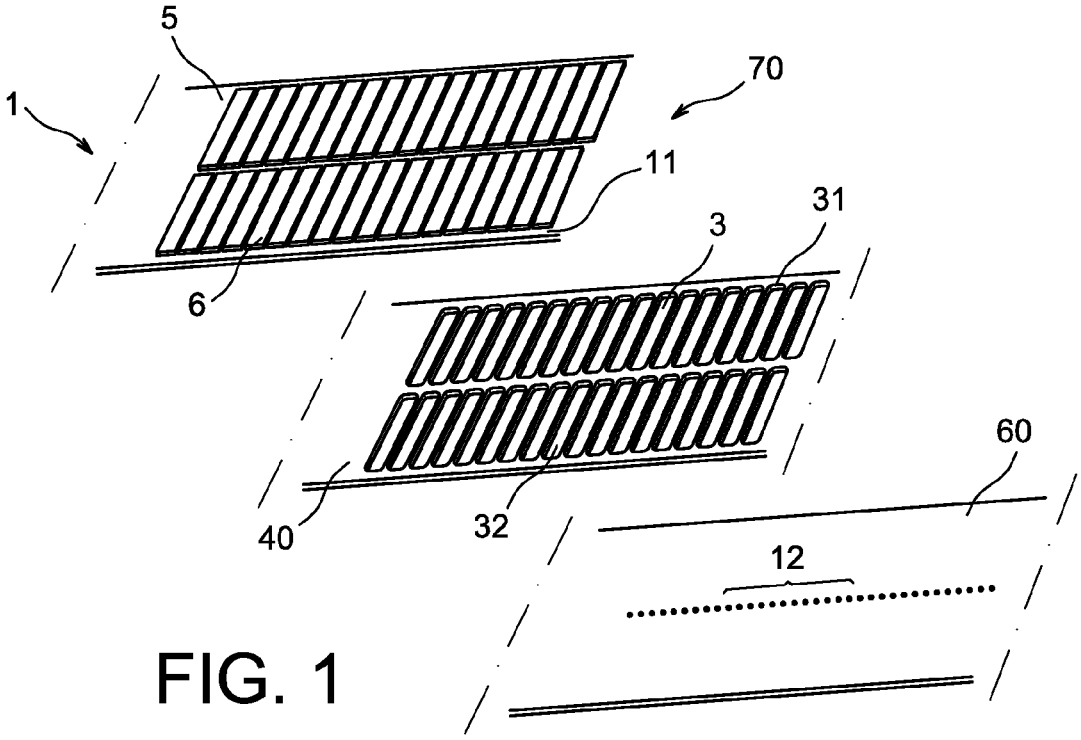
FIG. 1 represents an exploded perspective view of a part of three plates included in an assembly which together form a print head body which uses continuous jet technology, and to which the invention applies.
Figure 3:
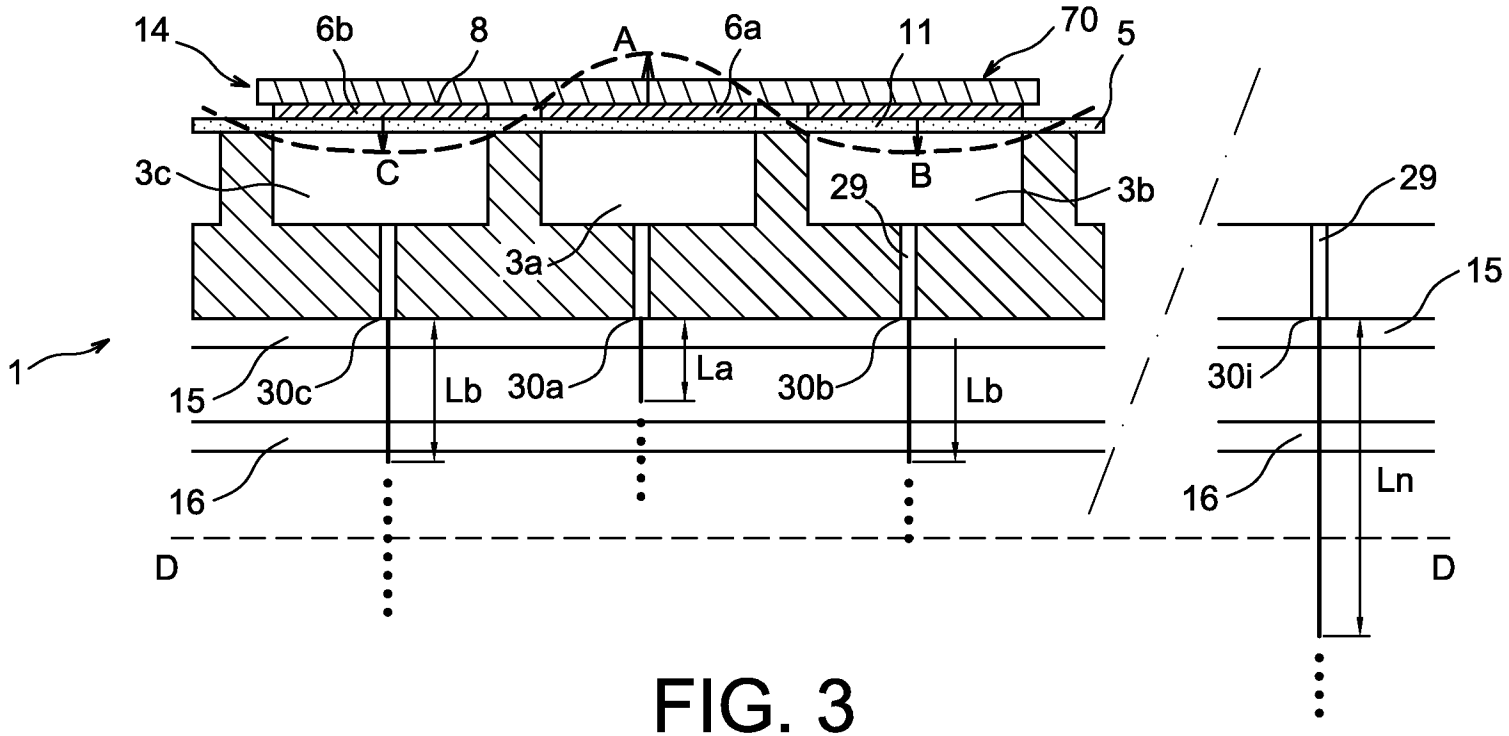
FIG. 3 is a schematic section along a plane passing through an alignment axis of the nozzles and which includes the axes of the jets, of a multi-nozzle drop generator of an ink-jet printer which uses continuous jet technology and to which the invention applies, and which illustrates the relationship between the mechanical deformation of the part of the diaphragm located above a chamber and the break-up length of an ink jet which results from this.

FIG. 1 shows an exploded view of a part of three plates 5, 40 and 60 included in an assembly of plates which together form the body 1 of the ink drop generator of a print head 70 to which the invention is applied. The print head itself forms part of an ink-jet printer which in particular includes an ink reservoir and means for pressurising the ink. The ink reservoir is hydraulically connected, on the one hand, to a recovery gutter for ink ejected by the nozzles and which is not used for printing, and on the other hand to the inlets to each of the stimulation chambers. These elements and their layout are themselves known and described, for example, in patent application WO 2005/070676. Consequently, these printer components will not be described in the present request. For convenience of description, it will be assumed that the plates 5, 40, and 60 are arranged along horizontal planes so that the direction perpendicular to the planes of the plates is vertical. Plate 5 forms a diaphragm, plate 40 includes cut-outs 3 each of which form a stimulation chamber, and plate 60 includes through openings 12 which form the start of a conduit 29, leading along a vertical axis from a chamber 3 to an outlet nozzle 30 from the body. The conduits 29 and the nozzles 30 are represented in FIG. 3. The conduits 29 are formed of a succession of through holes aligned along a vertical axis and which occur in other plates that are not shown, which form, with those represented in FIG. 1, the body of the drop generator.

Piezoelectric actuators 6 are arranged on the body 1 above the diaphragm 5. Each actuator is mechanically linked to a part 11 of the diaphragm, for example using adhesive. Each actuator 6 is this above a chamber 3. In the example shown, the chambers 3 and therefore the actuators 6 are arranged in two parallel rows, a first row and a second row. Although this arrangement is not compulsory, it advantageously allows the distance between consecutive nozzles 30 to be reduced, as has already been explained in connection with FIG. 2. The chambers 3 of the first and second row respectively have references 31 and 32. The diaphragm 5 is mechanically held by, for example, diffusion bonding over the entire surface of the plate 40 remaining after the cut-outs of this plate 40 which form the chambers 3. Thus it might be expected that each part 11 of the surface of the diagram 5 which holds an actuator 6 is mechanically independent of a consecutive part 11 of diaphragm 5 which holds another actuator 6, since it is firmly fixed to plate 40 over the entire perimeter of each part 11. In fact, the transmission of deformation occurs, as the inventor's investigation found and as will be described in connection with FIG. 3.

Figure 2:
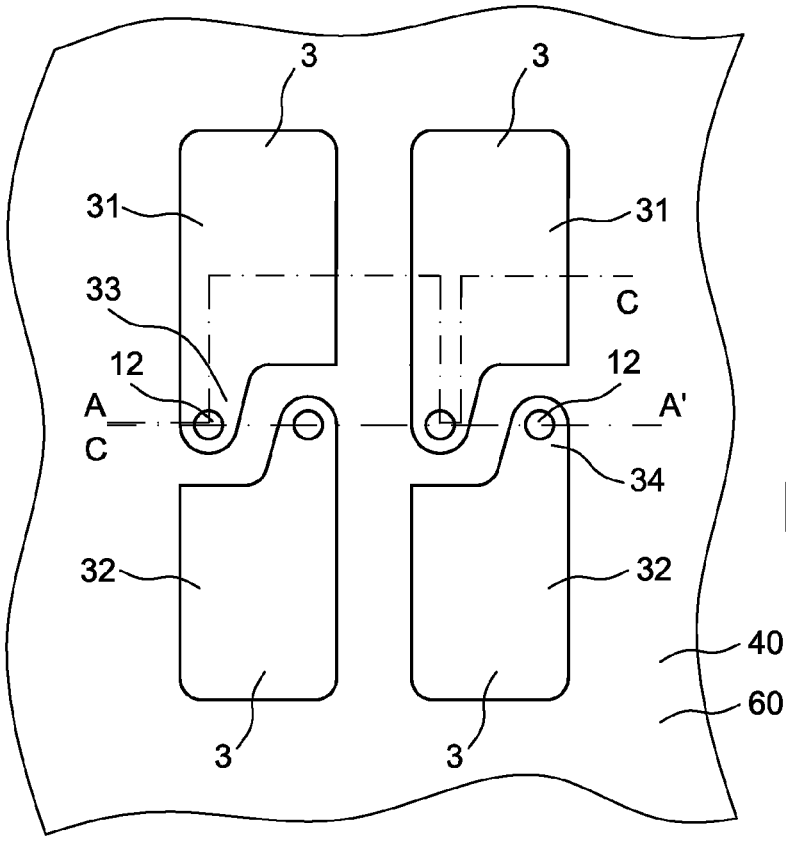
FIG. 2 represents an enlarged detailed viewed from above of a plate holding stimulation chambers and of a plate located below it.

FIG. 2 represents an enlarged view from above of two consecutive chambers 31 of the first row and two consecutive chambers 32 of the second row facing the two chambers 31 and of the plate 60 located below. Each chamber 31 possesses an extension 33 located to the left of the chamber. Each chamber 32 possesses an extension 34 located to the right of the chamber. The extensions 33 and 34 form secants with an axial line AA' located between the two rows of chambers. The widths of the extensions 33, 34 along an axial line parallel to the axis of alignment of the nozzles are less than half the width of a chamber measured along the same axis. Each of the extensions 33, 34 is arranged so that a part of this extension 33, 34 is above a through opening 12 in the plate 60. This opening forms the beginning of the hydraulic connection conduit 29 between a chamber 3 and a nozzle 30. It is stated that the distances between consecutive openings 12 are all equal to each other. This arrangement means that the distance between consecutive nozzles can be reduced by half relative to an embodiment which only includes a single row of chambers. The first of two consecutive nozzles in a row of nozzles is hydraulically connected to a chamber 31 of the first row of chambers and the other with a chamber 32 of the second row of chambers.

In other embodiments which include only one row of chambers, two consecutive nozzles of a line are hydraulically connected respectively to consecutive chambers in a row of chambers.

In the rest of the description and the claims, adjacent chambers are consecutive chambers in the same row of chambers.

FIG. 3 represents a part of a section of a drop generator of a print head 70 along an alignment axis of a row of chambers 3. The section plane follows the axes 30 of the jet discharge nozzles 30. In FIG. 3, an embodiment is represented which only includes one row of chambers 3. Three consecutive chambers with references 3*a*, 3*b* and 3*c* and one further away of which only the discharge nozzle is shown, are represented. The conduits 29 of the discharge jets are located in the middle of the chamber in the axial section plane. This arrangement is in no way compulsory, but simplifies the drawing. A piezoelectric actuator 6, 6*a*, 6*b*, 6*c* if functionally associated with each chamber 3, for chambers 3*a*, 3*b* and 3*c* respectively. A piezoelectric actuator control electrode 8 is placed above each of the piezoelectric actuators 6. It should be noted that by modifying the surface of this electrode 8, the value of a capacitance formed by this electrode 8 and the conductive surface of the part of the diaphragm 5 opposite this electrode 8 is modified. A circuit 19 represented in detail in a view from below FIG. 6, for example in the form of a printed board, includes conductive lines for the transmission of stimulation signals. In one embodiment of the invention these lines may in addition send the signals for compensating for mechanical crosstalk. A charge electrode 15 is located downstream of the nozzles, behind the section plane. A deflection electrode 16 is located downstream of the charge electrode, behind the section plane. The upstream-downstream direction is the direction of the flow from the jet. Electrodes 15, 16 are shown schematically. For a description of an embodiment of these electrodes reference could be made to patent application WO 2008/040777 in the name of the IMAJE S.A. company, published on Oct. 4, 2008. A recovery gutter which is mechanically linked to the body 1 has not been shown as it is unnecessary for an understanding of the invention. Represented in FIG. 3 is a dotted line DD. This line marks out a zone downstream of which the electrical influence of the electrodes 15, 16 on the trajectory of the drops is negligible.

The operation of the print head is itself known and is described in detail in, for example, the patent application WO 2007/042530 published Apr. 4, 2007 in the name of the MARKEM-IMAJE company. What is important to note about the present invention is that in the absence of a pulse to the actuator 6 of a chamber 3, the jet breaks up at a distance Ln from the nozzle 30, the so-called natural break-up distance of the jet. This distance Ln is shown at the discharge from the nozzle 30*i*. For correct operation the natural break-up point must be located downstream of the line DD. When a pulse is received, the distance from the nozzle of the jet break-up is reduced. Thus in the embodiment of continuous inkjet printers specific to the Markem-Imaje company, the jet break-up distance La for a drop intended for printing is controlled by the characteristics of a stimulation pulse signal received by the piezo-electric actuator that is operationally connected to the stimulation chamber from which this jet is issued. The distance La between the discharge from a nozzle 30 and the break-up point of the jet is shown at the nozzle discharge 30*a*.

Additional explanations relating to this known operation will now be given. First of all it is important to remember that in the printer described here, from the Markem-Imaje company, selection between drops intended for printing and drops which go towards the recovery gutter is achieved by control of the break-up point of the jet. The investigation carried out by the inventors has shown that when, for example, the actuator 6*a* receives a pulse, part 11 of diaphragm which covers the chamber 3*a* is deformed with an amplitude A as indicated by a curve represented as a broken line in FIG. 3. This so-called "bending mode" deformation itself results in a lesser deformation, also in "bending mode", and in the reverse direction, represented by B and C on the broken line curve, of the part 11 of the diaphragm, located above each of the chambers 3*b*, 3*c* adjacent to the chamber 3*a*. In operation in drop-on-demand mode, this deformation is insufficient to cause a drop to leave as explained above. This is why in operation in drop-on-demand mode, no crosstalk was observed. However, in continuous jet operation, the unwanted stimulation formed by this deformation for chambers adjacent to a chamber that is deliberately stimulated is sufficient to cause break-up of the jet from a conduit that is hydraulically connected to an adjacent chamber. The distance between a discharge nozzle 30 and the unwanted break-up point of the jet emerging from this nozzle is represented by Lb. This distance is not constant and depends in particular on the fact that a single adjacent chamber is deliberately stimulated or that two chambers adjacent to a given non-stimulated chamber are simultaneously stimulated. Finally the break-up distance La for a stimulated chamber is itself modified when two chambers adjacent to each other are simultaneously stimulated. These erratic modifications of the nominal jet break-up distances were only connected to the stimulation of adjacent chambers after numerous observations. These break-ups at erratic distances from nozzles and therefore in zones where the electric field values produced by the electrodes are not intended to control the trajectory of drops, are the source of a significant part of the fouling of the electrodes. Once the origin of the fouling was understood, the inventors then looked more closely at the printing test grids for printers with cleaned electrodes. They then observed that minimal printing defects were present. Of course, these faults will amplify as the electrodes get progressively more contaminated, and hence become more obvious.

In order to correct the operation that was thus observed, the inventors corrected the control of the stimulation electrodes 8. For each command pulse for an actuator 6*a* of a stimulated chamber 3*a*, an electrical pulse to compensate for mechanical crosstalk is sent to each of the actuators 6*b*, 6*c* of the chambers 3*b*, 3*c* adjacent to the stimulated chamber 3*a*.

A method for determining the relative value of the peak amplitude of the pulse to be sent to an actuator of an adjacent chamber to compensate for the mechanical crosstalk will now be described with reference to FIGS. 4 and 5.

Figure 4:
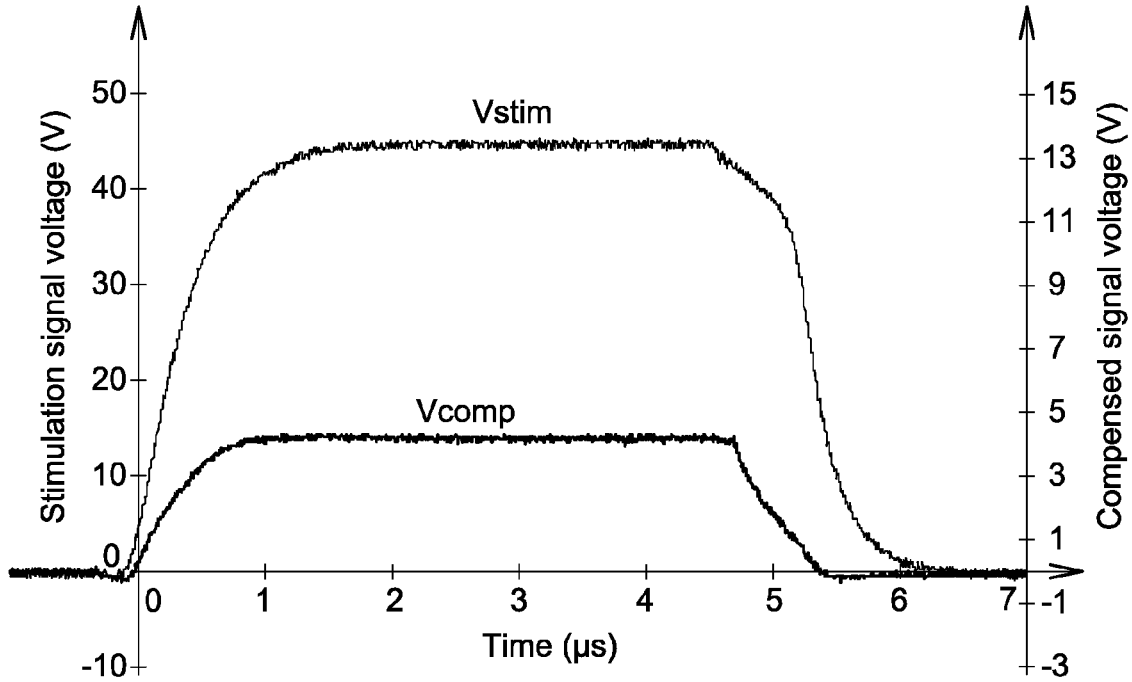
FIG. 4 illustrates the shapes of the two signals, one a stimulation signal, applied to an actuator of a stimulation chamber and the other a compensation signal applied to an actuator of an adjacent chamber.

FIG. 4 shows two curves in a drawing in which the ordinate shows voltage values and the abscissa shows durations. The first curve labelled Vstim in this drawing represents a stimulation pulse. The second curve Vcomp in this drawing represents a compensating pulse sent to the actuator of an adjacent chamber simultaneous with the stimulation pulse being sent. The rising and falling edges of these two pulses may not be homothetic with each other insofar as the peak voltages of each of the stimulation and compensating pulses have approximately constant values over a significant period in relation to the duration of the pulse.

Figure 5:
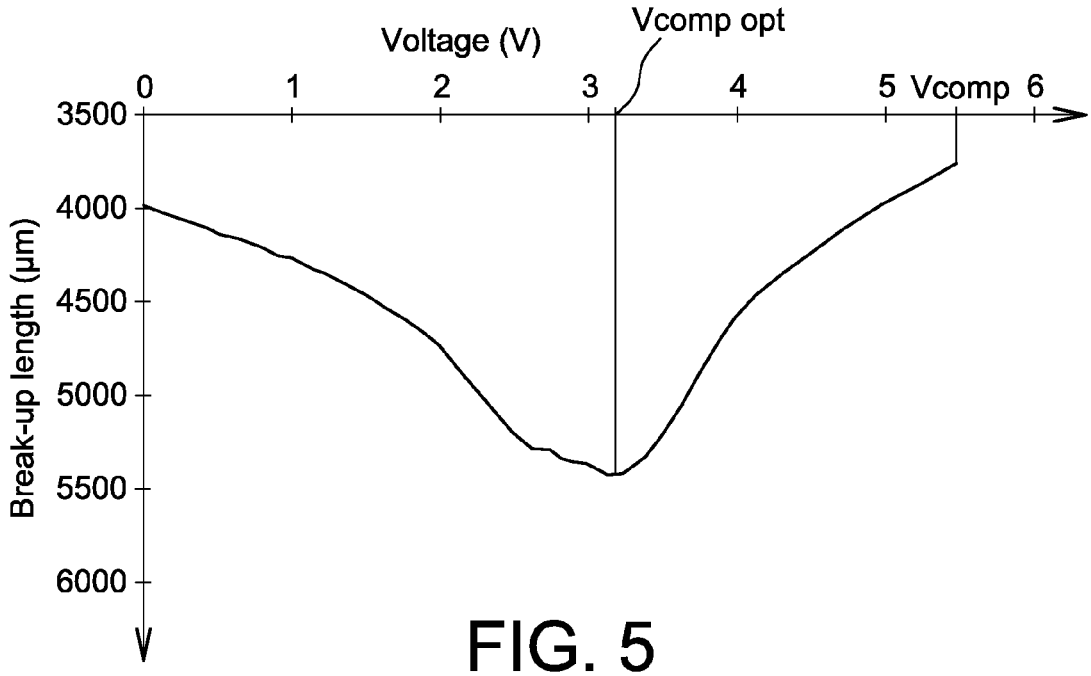
FIG. 5 shows a graph which illustrates an experimental method of determining the value of the ratio between the peak voltage applied to an actuator of a stimulated chamber and the peak voltage to be applied to the actuator of an adjacent chamber in order to compensate for the mechanical crosstalk.

The ordinate in FIG. 5 shows the jet break-up length Lb of a chamber adjacent to a stimulated chamber, as a function of the value of the peak voltage, shown on the abscissa, of a compensation pulse applied to the piezoelectric actuator 6 for this adjacent chamber. The compensation pulse has the same sign as the stimulation pulse and is applied simultaneously with the stimulation pulse. It will be seen in this curve that the break-up distance for the jet ejected by the nozzle of the chamber adjacent to the stimulated chamber follows a Gaussian type curve as a function of the value of the peak voltage Vcomp: it changes from a value of about 4000 μm when no compensation pulse is applied, to a maximum value of 5450 μm for an optimum Vcomp peak voltage value of 3.2 Volts, then falls back to 3750 μm for a peak voltage of the order of 5.5 Volts. It is found for the cases used in the experiments that the maximum value of the jet break-up distance was slightly less or even equal to the natural break-up distance of the jet. If one succeeds in obtaining a maximum jet break-up distance obtained for the optimum peak voltage which is equal to the natural break-up distance, this means that the compensation pulse exactly and completely compensates for mechanical crosstalk. If this is achieved, then all the better. If it is not achieved, then the aim of the invention will nevertheless have been achieved if the maximum jet break-up distance, although less than the natural break-up distance, is however sufficiently large for the drop produced by this break-up to be in a zone downstream of the line DD in FIG. 3, where its trajectory will only now be influenced by the electrodes if the drop was obtained at the natural break-up distance.

The absolute value of 3.2 volts stated in connection with FIG. 5 as the optimum compensation value is naturally not to be taken into consideration. This value is a function of the peak voltage value applied to the stimulation pulse. In the present case, as shown in FIG. 4, the peak value for the stimulation pulse is about 45 Volts. The optimum value of the voltage Vcomp of 3.2 volts represents 3.2/45 that is about 7/100 of the stimulation pulse voltage value. Furthermore, it should be noted that close to the maximum break-up distance, the break-up distance remains close to the maximum break-up distance over quite a wide voltage range. For example, in the case discussed in relation to FIG. 5, the break-up distance remains at 5200 μm for peak voltage values running from 2.2 Volts to 3.6 volts, leading to ratios of compensation voltage to stimulation voltage of between 5/100 and 8/100. Thus the flat shape of the curve close to the optimum compensation voltage means that for a given printer or print head, there is a margin for choosing a value of the ratio of the compensation peak value and the stimulation peak value. The embodiments of circuits 19 for control of the actuators will now be described in association with FIGS. 6 to 9.

Figure 6:
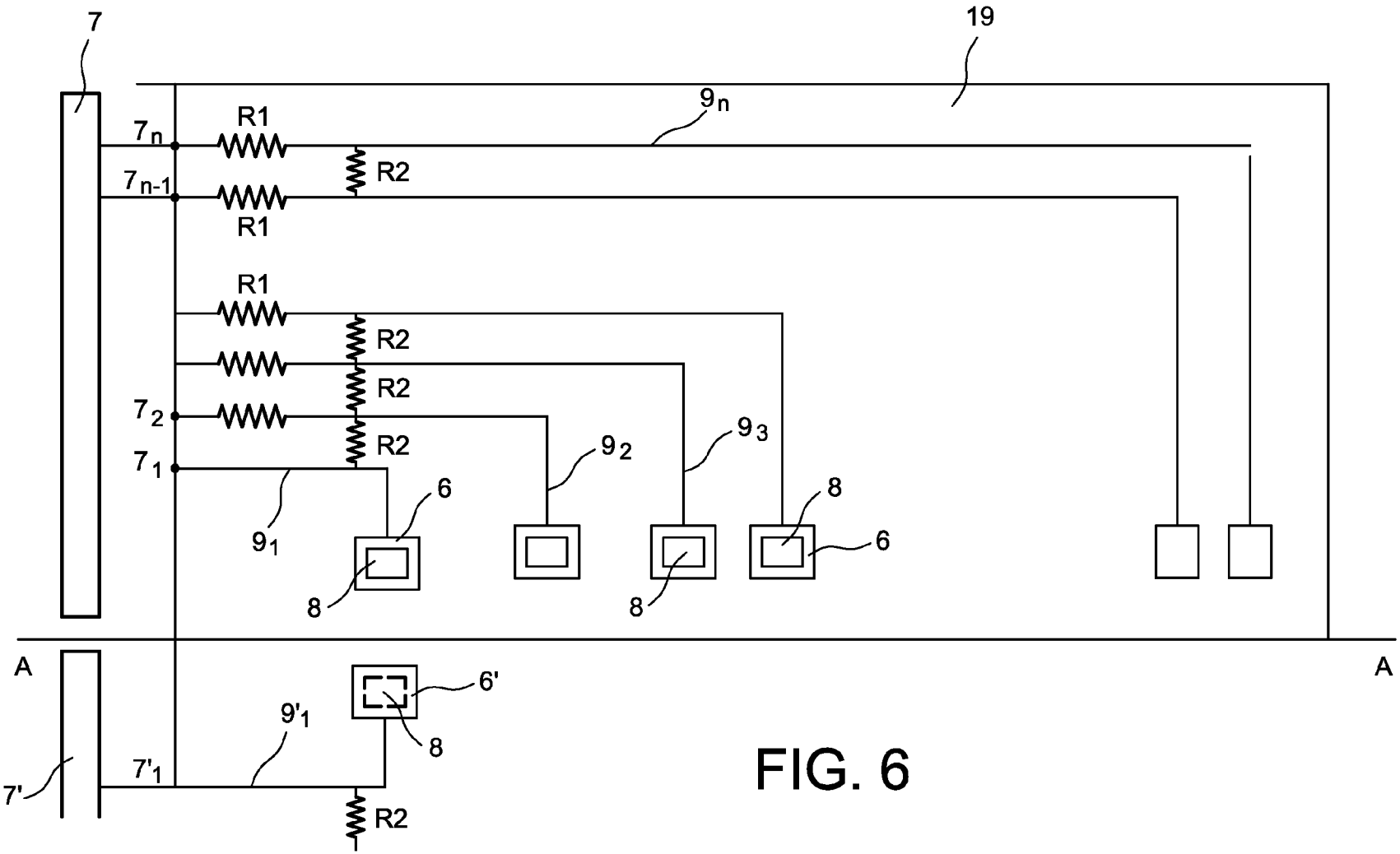
FIG. 6 is a view of an electrical circuit diagram at the outlet from a device for processing the data to be printed and through which the stimulation pulses pass to each of the actuators of a continuous jet printer according to the invention.

In a first preferred embodiment represented in FIG. 6, a material electrical coupling is achieved between stimulation lines 9 ($9_1$, $9_2$, $9_3$, $9_n$) supplying actuators 6 of adjacent chambers. The circuit represented in a view from below in FIG. 6 is derived from a circuit which does not initially include means for sending compensation pulses to adjacent actuators.

This circuit is formed on a printed board 19. This embodiment on a printed circuit is in no way compulsory, but is convenient when the body 1 of the drop generator is made up of a stack of plates. The actuators 6 are arranged on the printed circuit so that when the printed circuit is returned over the flat diaphragm 5 of the body 1 of the drop generator, and put in place on this diaphragm, the actuators 6 occupy the location that they must occupy above each of the chambers 3 of the body 1. The electrical command lines $9_1, 9_2 \ldots 9_n$ respectively couple each output $7_1, 7_2, \ldots 7_{n-1}, 7_n$ of a device for processing data to be printed 7 to an electrode 8 supplying an actuator 6. When the printed circuit 19 is put in place, each electrode 8 forms with the upper conductive surface of the diaphragm 5 opposite it, made for example of steel, a capacitance 14 represented in FIG. 3 above the part of the diaphragm which covers the chamber 3*b*. It should be understood that such a capacitance 14 is formed in this way for each actuator 6.

In accordance with the specific mode of the invention described here, a passive component, for example a resistance R1, is incorporated in each line 9. In this embodiment the incorporation of the resistance R1 is not compulsory. In particular, if the line impedance Z1, which results in particular from the circuits upstream of the transmission lines 9 is quite large. Furthermore each line 9 which supplies a chamber actuator is electrically connected by a resistance R2 to each line 9 supplying an actuator arranged on a chamber adjacent to the said chamber. The assembly R1, R2 forms a voltage divider bridge. Thus when a voltage V is applied to an actuator of a stimulated chamber, a lesser voltage V' is applied to each chamber actuator adjacent to the said stimulated chamber. Determination of the value of the reduction ratio R2/R1=V'/V has been explained above in connection with FIGS. 4 and 5.

This embodiment is particularly simple and meets the desired compensation criteria. Thus, when a stimulation pulse is sent to an actuator of a stimulated chamber, a compensation pulse is sent to each of the chambers which are adjacent to it, when a stimulation pulse is simultaneously sent to the actuators of two chambers adjacent to each other, a stimulation pulse is sent to each of the actuators of each of these stimulated chambers whose peak value is increased by the value of the peak value of a compensation pulse, this the break-up distance of a stimulated jet is not modified by the simultaneous stimulation of the adjacent chamber, and finally when two stimulated chambers are adjacent to a given non-stimulated chamber, a compensation pulse is sent to the actuator of the non-stimulated chamber located between the two stimulated chambers, whose peak value is double the peak value of a compensation pulse received when a single adjacent chamber is stimulated. Thus the crosstalk from two stimulated chambers adjacent to a given chamber is compensated for.

It should be noted that the sending of compensation pulses such has just been described may be achieved by means for software available to those working in the field. The device for processing of data to be printed 7 includes in general a processor that just needs to be processed for this purpose. In this case the print head does not include means for compensation since these means are included in the printer upstream of the print head.

The circuit represented in FIG. 6 above an axis AA is applicable to an embodiment in which a single row of chambers is present. In the case where there are two rows of chambers present, as shown in FIG. 2, the printed circuit board 19 is supplemented by an additional circuit which is symmetrical to that shown above the axis AA in relation to the said axis AA. FIG. 6 only shows the first line 9'1, coupled to an output 7'1 of the device for processing data to be printed 7, which supplies a first actuator 6' of the second row of chambers.

Figure 7:
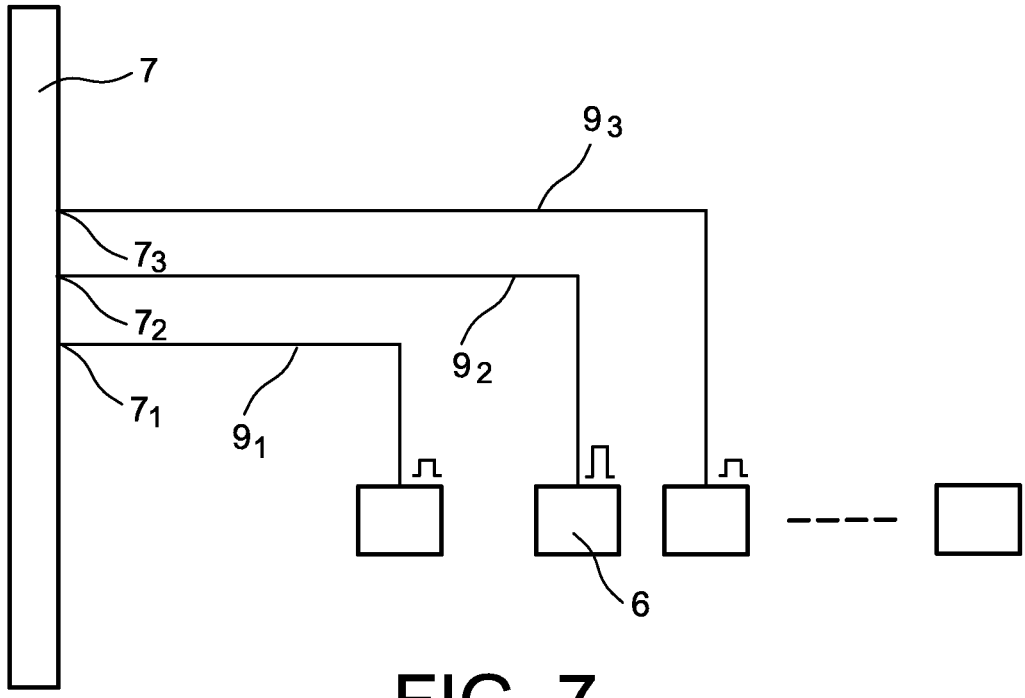
FIGS. 7 to 9 each illustrate means for coupling between stimulation lines which supply chambers adjacent to each other. The means for coupling are, for each figure, shown for two lines only but it must be understood the same means for coupling are present between each group of two lines supplying adjacent chambers.
Figure 8:
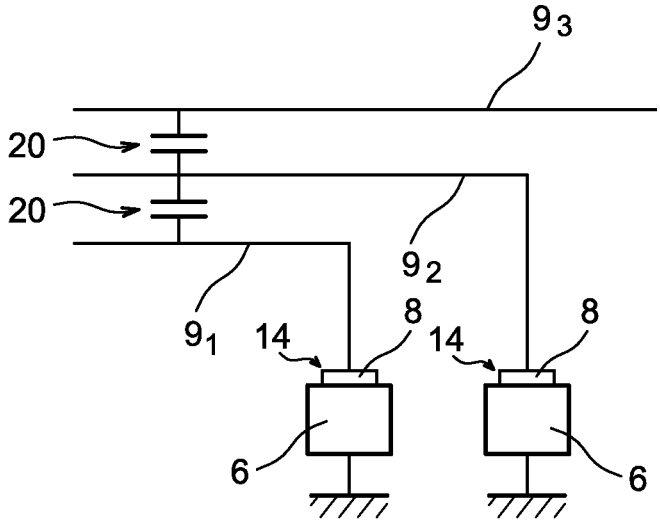
Figure 9:
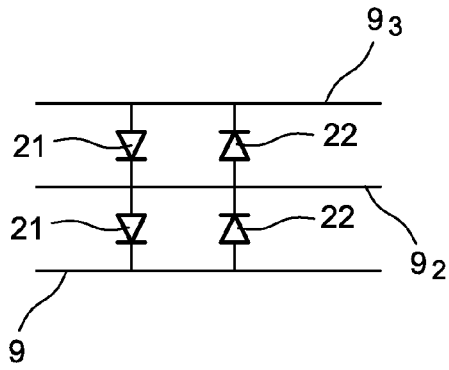

In an alternative embodiment to those modes shown in FIGS. 6, 8 and 9 the circuit 19 has the form represented in FIG. 7. In this alternative mode the printer is equipped, for example at the device for processing the data to be printed 7, with means for producing and sending stimulation and compensation pulses to the chambers adjacent to the stimulated chamber. Thus, as shown in FIG. 7, simultaneous with sending a stimulation pulse to, for example, actuator 6 supplied by line $\mathbf{9}_2$, the device 7 sends to each of the actuators 6 of adjacent chambers supplied by lines $\mathbf{9}_1$ and $\mathbf{9}_3$, a reduced pulse for compensating for crosstalk. The means for sending pulses may be line coupling components such as those described in connection with FIG. 6, or those which are to be described in connection with FIGS. 8 and 9, but applied to parts of line 9 which are found upstream of the print head, for example, inside the device for processing of the data to be printed 7. It may also involve software means as explained above. In a second embodiment shown in FIG. 8, coupling is achieved using a divider bridge which includes other passive elements, for example a capacitance 20 is coupled between lines supplying actuators 6 of adjacent chambers $\mathbf{9}_1$, $\mathbf{9}_2$; $\mathbf{9}_2$, $\mathbf{9}_3$. The divider bridge is a capacitive bridge formed, on the one hand, from a capacitance 14 on each of the lines 9, and on the other hand from the capacitance 20. The value of the capacitance 20 connected between two supply lines 9 for consecutive chambers is determined as a function of the value of the capacitance 14 and of the V'/V ratio as explained above.

In the mode represented in FIG. 8, it should be noted that, advantageously, the capacitance formed around the actuator 6 by the control electrode 8 and the conductive surface of the diaphragm has been used. The value of this capacitance 14 may be adjusted by, for example, adjusting the surface of the control electrode.

In a third embodiment, represented in FIG. 9, the lines 9 of actuators of adjacent chambers are coupled two at a time by an assembly of Zener diodes 21, 22 in parallel and have opposite passing directions. Thus when one of the lines receives a pulse, the other receives it but with amplitude which peaks at the diode voltage limit value. Naturally this limiting value is selected so that the V'/V ratio thus obtained is suitable.

Figure 10:
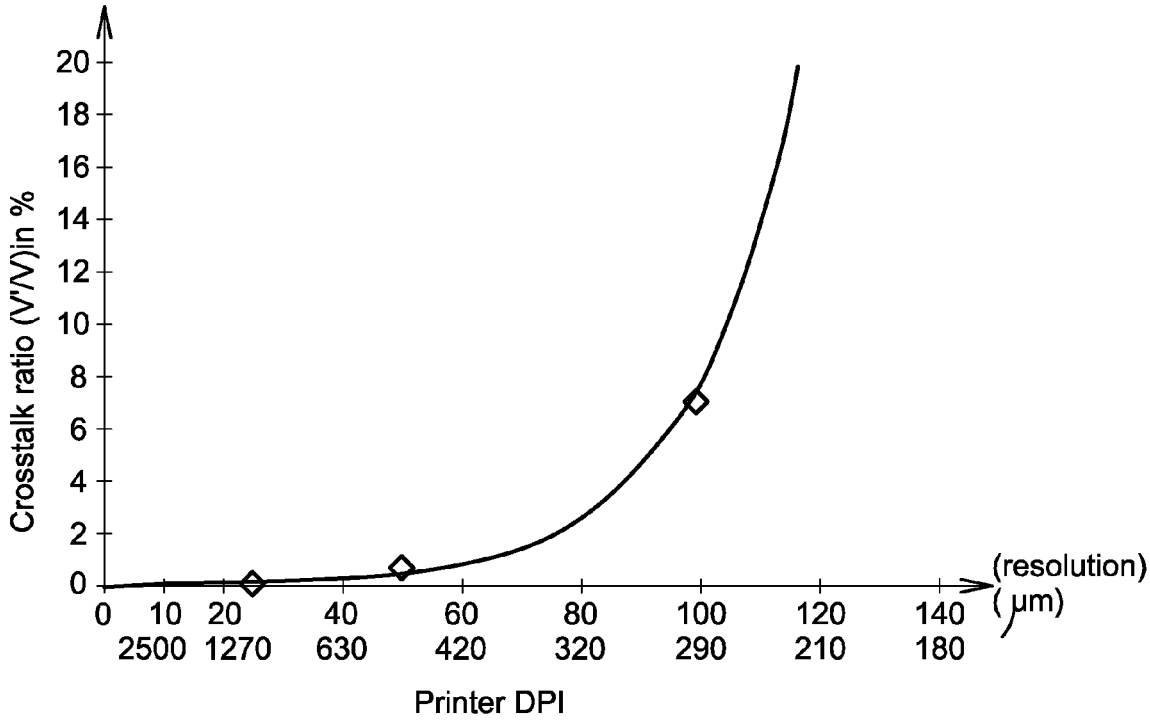
FIG. 10 is a graph whose ordinate represents the value of the ratio between peak voltages for the compensation pulse and for the stimulation pulse for a steel diaphragm, as a function of the number of DPI on the abscissa.

The graph shown in FIG. 10 represents the variation of the V'/V ratio as a function of the number of dots per inch (DPI) for a printer which has a diaphragm 5 made of steel with a thickness of 50 μm. The first line of the abscissa axis shows the number of dots per inch and the second line shows the value of the corresponding gap between consecutive nozzles, that is, the approximate value of 25400 μm divided by the number of dots per inch. It can be seen that the ratio V'/V increases with the number of DPI. The inventors consider it reasonable to envisage that the ratio V'/V lies between the values below:

0.05 hundredths and 0.5 hundredths for printers where the gap between consecutive nozzles is between 2500 and 625 μm;

0.1 hundredths and 5 hundredths for printers where the gap between consecutive nozzles is between 830 and 310 μm;

1 hundredth and 20 hundredths for printers where the gap between consecutive nozzles is between 360 and 190 μm;

4 and 30 hundredths for printers where the gap between consecutive nozzles is between 300 and 200 μm;

The various embodiments of the invention allow operating times for the printer to be increased without undesirable fouling of electrodes, and therefore operational autonomy can be increased.

Furthermore the printing quality is improved since the distribution of drops intended for printing is better controlled.

The invention claimed is:

1. A continuous inkjet printer, comprising:

a print head which includes multiple stimulation chambers aligned along an alignment axis for said chambers;

a flat diaphragm whose parts form a wall of each of the stimulation chambers;

multiple nozzles each respectively hydraulically connected to one of the stimulation chambers;

at least one charge electrode and a deflection electrode located downstream of the nozzles;

multiple electro-mechanical actuators, each respectively mechanically linked to each of the parts of the diaphragm forming a wall of each of the stimulation chambers;

multiple stimulation lines each configured to transmit respective stimulation pulses to each of the various actuators;

a device for processing data to be printed which receives a signal carrying the data to be printed and which supplies stimulation pulses, as a function of said data to be printed, to the stimulation lines; and means for compensating for mechanical crosstalk between adjacent chambers, said means for compensating being configured to transmit, simultaneously with transmission to a stimulated chamber of a stimulation pulse over a simulation line, a pulse for compensating for mechanical crosstalk on each of a plurality of lines which supply an actuator for the chamber adjacent to the stimulated chamber, the compensating means being adapted to transmit one of a pulse for compensating for crosstalk which peak amplitude is between 0.05 hundredths and 0.5 hundredths of a peak voltage value of the stimulation pulse, wherein gaps between consecutive nozzles are between 2500 and 625 μm;

a pulse for compensating for crosstalk which peak amplitude is between 0.1 hundredths and 5 hundredths of a peak voltage value of the stimulation pulse, wherein gaps between consecutive nozzles are between 830 and 310 μm;

a pulse for compensating for crosstalk which peak amplitude is between 1 hundredth and 20 hundredths of a peak voltage value of the stimulation pulse, wherein gaps between consecutive nozzles are between 360 and 190 μm; and a pulse for compensating for crosstalk which peak amplitude is between 4 hundredths and 30 hundredths of a peak voltage value of the stimulation pulse, wherein gaps between consecutive nozzles are between 300 and 200 μm.

2. The continuous inkjet printer according to claim 1, wherein the means for compensating for mechanical crosstalk between adjacent chambers includes passive components for coupling between lines which supply actuators of adjacent chambers.

3. The continuous inkjet printer according to claim 2, wherein the passive coupling components comprise a resistive voltage divider bridge, and wherein each line has a first impedance and is coupled to each line supplying an adjacent chamber actuator through a second impedance.

4. The continuous inkjet printer according to claim 2, wherein the passive coupling components are selected from a group which contains a capacitance, a resistance and a capacitance in series, and a resistance and a capacitance in parallel.

5. The continuous inkjet printer according to claim 1, wherein the means for compensating for mechanical crosstalk between adjacent chambers includes two Zener diodes for coupling between lines which supply actuators of adjacent chambers, and wherein the two Zener diodes have opposite passing directions with respect to each other.

6. A print head for a continuous inkjet printer, comprising:

multiple stimulation chambers aligned along an alignment axis for said multiple stimulation chambers;

a flat diaphragm whose parts form a wall of each of the stimulation chambers;

multiple nozzles each respectively hydraulically connected to one of the stimulation chambers;

at least one charge electrode and a deflection electrode located downstream of the nozzles;

multiple electro-mechanical actuators, each respectively mechanically linked to each of the parts of the diaphragm which form a wall of each of the stimulation chambers;

multiple stimulation lines each designed to respectively transmit stimulation pulses to each of the various actuators; and means for compensating for mechanical crosstalk between adjacent chambers, said means for compensating being configured to transmit, simultaneously with transmission to a stimulation chamber of a stimulation pulse over a simulation line, a pulse for compensating for mechanical crosstalk on each of a plurality of lines supplying an actuator for the chamber adjacent to the stimulated chamber, the compensating means being adapted to transmit one of a pulse for compensating for crosstalk which peak amplitude is between 0.05 hundredths and 0.5 hundredths of a peak voltage value of the stimulation pulse, wherein gaps between consecutive nozzles are between 2500 and 625 μm;

a pulse for compensating for crosstalk which peak amplitude is between 0.1 hundredths and 5 hundredths of a peak voltage value of the stimulation pulse, wherein gaps between consecutive nozzles are between 830 and 310 μm;

a pulse for compensating for crosstalk which peak amplitude is between 1 hundredth and 20 hundredths of a peak voltage value of the stimulation pulse, wherein gaps between consecutive nozzles are between 360 and 190 μm; and a pulse for compensating for crosstalk which peak amplitude is between 4 hundredths and 30 hundredths of a peak voltage value of the stimulation pulse, wherein gaps between consecutive nozzles are between 300 and 200 μm.

7. The print head for a continuous inkjet printer according to claim 6, wherein the means for compensating for mechanical crosstalk between adjacent chambers includes passive components for coupling between lines which supply actuators of adjacent chambers.

8. The print head according to claim 7, wherein the passive coupling components comprise a resistive voltage divider bridge, and wherein each line has a first impedance and is coupled to each line supplying an adjacent chamber actuator through a second impedance.

9. The print head according to claim 7, wherein the passive coupling components are selected from a group which contains a capacitance, a resistance and a capacitance in series, and a resistance and a capacitance in parallel.

10. The print head according to claim 6, wherein the means for compensating for mechanical crosstalk between adjacent chambers includes two Zener diodes for coupling between lines which supply actuators of adjacent chambers, and wherein the two Zener diodes have opposite passing directions with respect to each other.

* * * * *